US008668127B2

(12) United States Patent
Baron

(10) Patent No.: US 8,668,127 B2
(45) Date of Patent: Mar. 11, 2014

(54) STRETCHABLE BACKPACK

(76) Inventor: Jake Ryan Baron, Annapolis, MD (US)

( * ) Notice: Subject to any disclaimer, the term of this patent is extended or adjusted under 35 U.S.C. 154(b) by 429 days.

(21) Appl. No.: 12/929,957

(22) Filed: Feb. 28, 2011

(65) Prior Publication Data

US 2012/0217280 A1 Aug. 30, 2012

(51) Int. Cl.
*A45F 3/02* (2006.01)

(52) U.S. Cl.
USPC ..... 224/602

(58) Field of Classification Search
USPC ..... 224/600, 602, 603, 606, 257, 660, 664, 224/219, 221, 222, 623; D3/327, 224, 215, D3/225; 150/107
See application file for complete search history.

(56) References Cited

U.S. PATENT DOCUMENTS

| | | | | |
|---|---|---|---|---|
| 1,110,694 | A * | 9/1914 | Jennings | 224/602 |
| 4,569,465 | A | 2/1986 | O'Farrell | 224/224 |
| 4,976,388 | A | 12/1990 | Coontz | 224/264 |
| 5,269,023 | A * | 12/1993 | Ross | 2/66 |
| 5,607,092 | A | 3/1997 | Alexander | 224/258 |
| 5,695,102 | A | 12/1997 | Jackson | 224/264 |
| 5,769,295 | A | 6/1998 | Alves | 224/613 |
| 6,296,164 | B1 | 10/2001 | Russo | 224/602 |
| 6,311,336 | B1 * | 11/2001 | Gootrad | 2/251 |
| 6,698,636 | B2 | 3/2004 | Angus et al. | 224/660 |
| 6,886,726 | B1 * | 5/2005 | O'Hare | 224/576 |
| D505,787 | S * | 6/2005 | Vaughn | D3/224 |
| 7,036,642 | B2 | 5/2006 | Hoberman et al. | 190/36 |
| 7,204,399 | B2 | 4/2007 | Collier et al. | 224/631 |
| 7,431,184 | B2 | 10/2008 | Gregory | 224/627 |
| 8,104,654 | B2 * | 1/2012 | Overton | 224/581 |
| D661,484 | S * | 6/2012 | Hamra | D3/224 |
| 2004/0211798 | A1 * | 10/2004 | Schechter | 224/222 |
| 2007/0095871 | A1 * | 5/2007 | Chen | 224/219 |
| 2010/0133310 | A1 * | 6/2010 | Menzel et al. | 224/602 |
| 2013/0068804 | A1 * | 3/2013 | Tweedie | 224/148.1 |

* cited by examiner

*Primary Examiner* — Justin Larson
(74) *Attorney, Agent, or Firm* — Studebaker & Brackett PC

(57) ABSTRACT

A backpack is positioned to rest in an essentially flat configuration between the shoulder blades, so as to mitigate backpack pain or stress. The pack is worn tightly across the individual to eliminate the downward forces of the weight included in a pocket having a rhombus shape. Stretchable material of the pack conforms to the contents of the pack. Effectively, the weight of the pack is distributed across the chest and back of an individual to provide a "weightless effect".

8 Claims, 6 Drawing Sheets

STRETCHABLE BACKPACK

FIELD OF THE INVENTION

The present invention relates to the field of a backpack made of stretchable material so as to secure its contents in place and distribute the weight of the contents of the backpack across the back and chest of the wearer.

BACKGROUND OF THE INVENTION

Various backpacks are known having a single shoulder strap or two shoulder straps to support the weight of the backpack on the shoulder or shoulders of an individual. These backpacks introduce a strain to the shoulder or shoulders of an individual which, over time, can cause pain and/or injury.

Alternatively, a pack that is secured around the waist of an individual places the weight of the load at a lower portion of a back. This also can result in injury to the wearer, depending upon the amount of weight being carried.

Further, whether the backpack is of a single shoulder, double shoulder or hip belt configuration, the weight of its contents is shiftable on the individual tending to introduce instability in use. This may be alleviated by a weight supporting belt and/or a sternum strap to provide additional measures of securing the pack to an individual. However, there is a need for a simple yet durable pack which evenly distributes the weight of its contents, so as not to encumber the movement of an individual and provide a "weightless effect".

SUMMARY OF THE INVENTION

Accordingly, it is an object of the present invention to provide a backpack from, preferably, two pieces of material, secured to each other. A first one of the pieces of material has a lay flat configuration of a T-shape. The T-shape includes two arms, forming straps, extending laterally from opposite sides of an upper portion of a stem portion of the "T". The second piece of material is of square or rectangular shape and is secured by stitching to the first piece of material to form a pocket.

The two pieces of material of the pack are preferably made of a stretchable material so as to tightly grip the contents of the pack when the pack is secured across the chest of an individual. A strap formed by one arm of the T-shaped material extends from the back of the individual, over one shoulder and across the chest of the individual. The other strap formed by the other arm of the T-shaped material extends from the back and under the arm of the opposite side of the individual. The two straps are removably secured to each other across the chest of the individual.

Due to the stretchable material of the pack, the pack is positioned to rest in an essentially flat configuration between the shoulder blades, so as to mitigate backpack pain or stress. The pack is worn tightly across the individual to eliminate the downward forces of the weight included in a pocket having a rhombus shape. The stretchable material conforms to the contents of the pack. Effectively, the weight of the pack is distributed across the chest and back of an individual to provide a "weightless effect". The person does not notice the effect of the weight from the pack. The pack conforms to the shape of the back providing an aerodynamic configuration to reduce drag and resistance on the body.

The stretchable material used may be neoprene material available from Dupont. G-type neoprene may be used having a thickness of ⅛ of an inch to ¼ of an inch. The stretchability of the neoprene material is approximately 1.5 to 2.5, and preferably 1.5 to 2.0 times its size at rest to provide the necessary stretching of the material to hug the contents of the pack and conform to the shape of the body of the individual wearing the pack.

By the inverted T-shaped configuration of one piece of material of the pack, a pocket is provided within which materials, typically textbooks and notebooks, may be positioned. A flap formed by a bottom portion of the stem portion of the "T" covers the opening into the pocket and is secured in place by a plurality of hook and loop fasteners such as are available under the trademark Velcro®. The tight closure of the pocket and the stretching of the pocket itself around its contents provides a secure package.

Opposing straps extending from opposite sides of the pocket are positioned to pass over one shoulder on one side of the body and under the arm of an individual on the opposite side of the body. The straps meet in front of the chest area on the front of the individual and are interconnected by hook and loop fasteners. An optional pocket is located on one of the two arms for holding of a water bottle or wallet and keys of an individual, for example.

When the flap seals the pocket of the pack, and the pack is worn, the flap is compressed between the pocket and the back of the individual. A fold line for collapsing the flap over the pack is worn vertically uppermost in the pack, so as to aid in sealing the contents of the pack in the pocket. The flap pressed against the back of an individual is assisted in being secured in place.

When the arms of the pack are stretched to connect on the chest of the wearer, the material of the pack is further stretched to conform to the configuration of the individual, so as to minimize the extension of the pack away from the body. The stretching of the pack and the compression of the materials contained in the pocket of the pack aids in the distribution of the weight of the pack across the chest, sides and back of an individual so that it is difficult to even feel the weight of the pack when worn correctly.

Accordingly, it is another object of the present invention to provide a backpack made of a stretchable material which is secured on the back of an individual by two opposing arms which connect on the chest of the individual after passing over one shoulder and under the arm of an opposite side of an individual.

It is still another object of the present invention to provide a backpack made of a stretchable material which is secured on the back of an individual by two opposing arms which connect on the chest of the individual after passing over one shoulder and under the arm of an opposite side of an individual with a pocket for holding the contents of the backpack being sealed by a flap positioned between the back of the individual and the pocket of the backpack.

It is still yet another object of the present invention to provide a backpack made of a stretchable material which is secured on the back of an individual by two opposing arms which connect on the chest of the individual after passing over one shoulder and under the arm of an opposite side of an individual with a pocket for holding the contents of the backpack being sealed by a flap positioned between the back of the individual and the pocket of the backpack where the flap is secured over the pocket by hook and loop fasteners and the opposed arms connect on the chest of the individual also by hook and loop fasteners after being pulled to meet over the chest and stretch the material of the backpack to conform to the shape of an individual.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
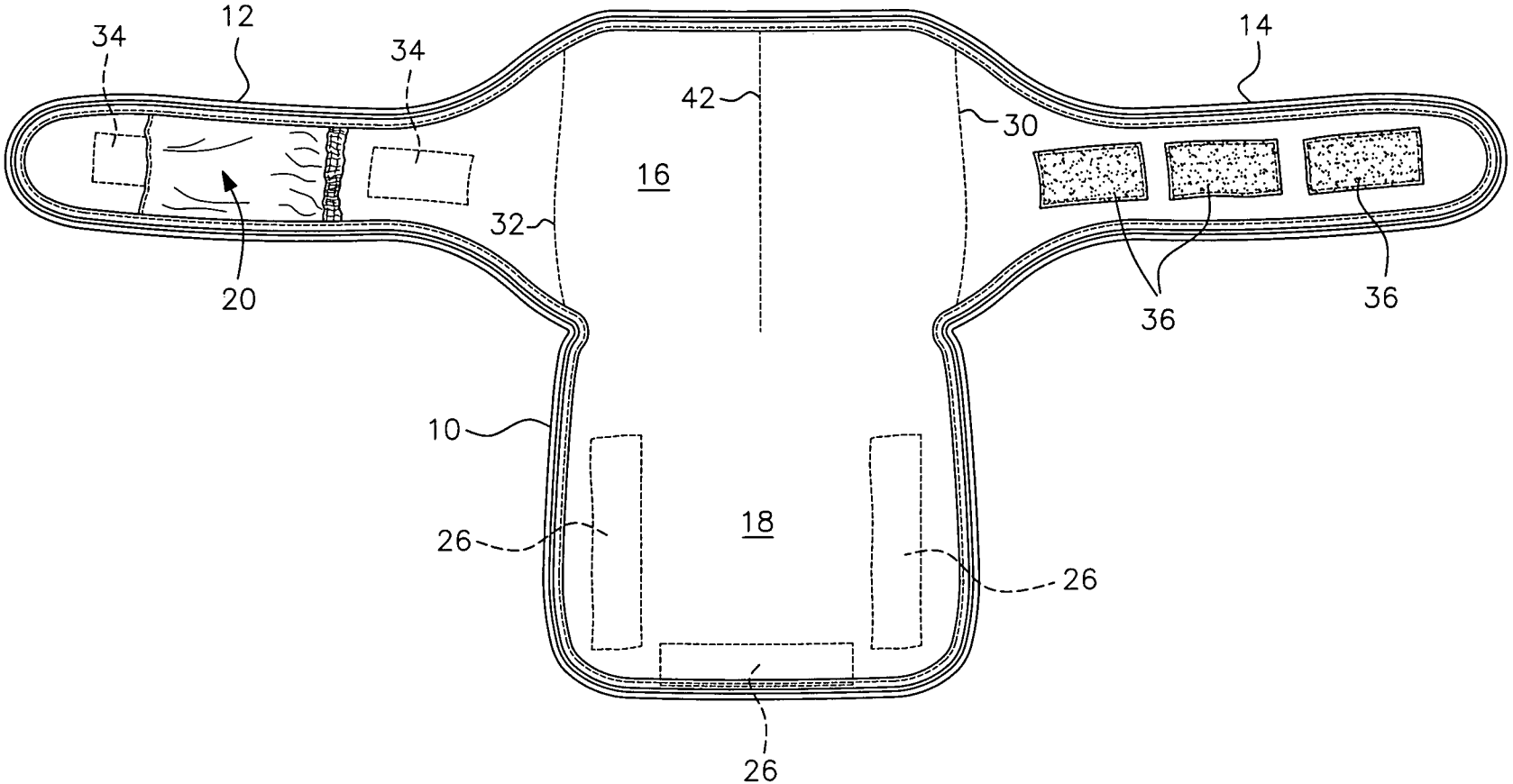
FIG. 1 is a rear view of a T-shape piece of material of the backpack, shown in a lay flat condition.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
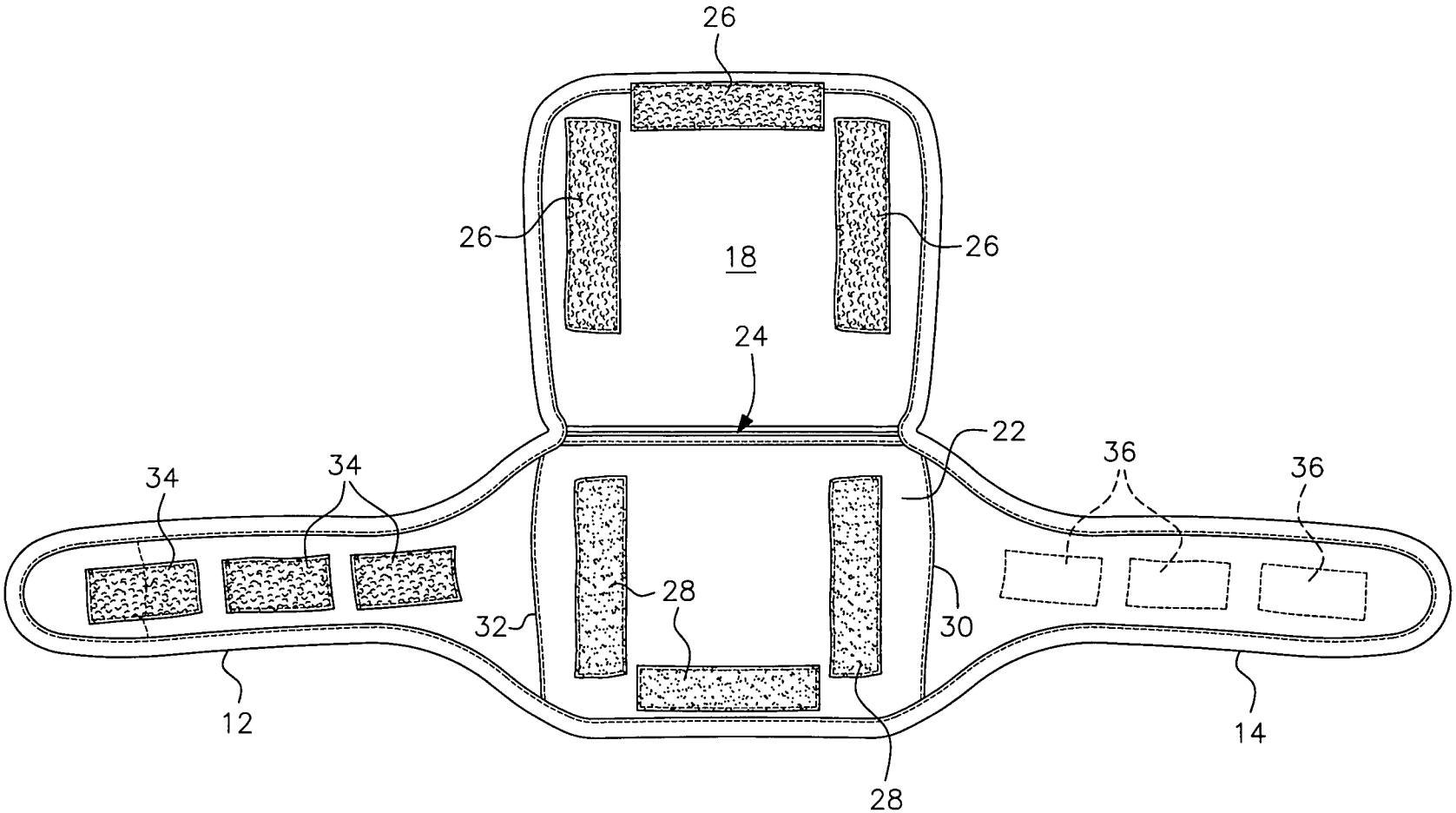
FIG. 2 is a front view of the T-shape piece of material in an inverted position, having another piece of material secured to the T-shape material to form a pocket therebetween.

With reference to the drawings, in general, and to FIGS. 1 and 2, in particular, a backpack embodying the teachings of the subject invention is shown. With reference to its orientation in FIG. 1, the backpack, in its lay flat configuration, includes two pieces of material with one of the pieces of material 10 in the shape of a "T".

The T-shaped piece of material includes two arms 12 and 14 extending laterally from an upper portion of a central stem portion. The central stem portion from which the arms extend includes an upper pocket portion 16 and a lower flap portion 18. The backpack including the T-shaped piece of material 10 as shown in FIG. 1, is preferably of a single piece of stretchable material, except for the compartment 20 for holding a bottle or personal items of an individual.

It is only when the backpack lay flat configuration is reversed and inverted, as shown in FIG. 2, that an additional or second layer of material 22 in a preferably rectangular shape is secured by stitching lines 30, 32 to the single T-shaped piece of material 10 shown in FIG. 1. A pocket 24 is formed therebetween for holding the contents of the backpack.

In FIG. 2, the flap portion 18 includes three parts 26 of a hook and loop fastener. The complementary parts 28 of the hook and loop fastener are found on the layer of material 22 which is secured to the T-shaped piece of material.

The arms 12, 14 serve as straps for securing the backpack around an individual. To secure the two arms 12, 14 together, arm 12 includes parts 34 of hook and loop fasteners. The other parts 36 of the hook and loop fasteners are located on the opposite side of arm 14.

By using three parts 34 and three parts 36 spaced across the arms 12, 14, respectively, an adjustability is provided for overlap of arm 12 onto arm 14 in an infinite number of positions. The position of interconnection of the arms 12, 14 depends upon the size of the individual, so as to stretch the arms 12, 14 as well as the upper pocket portion 16 across the back of an individual.

Figure 3:
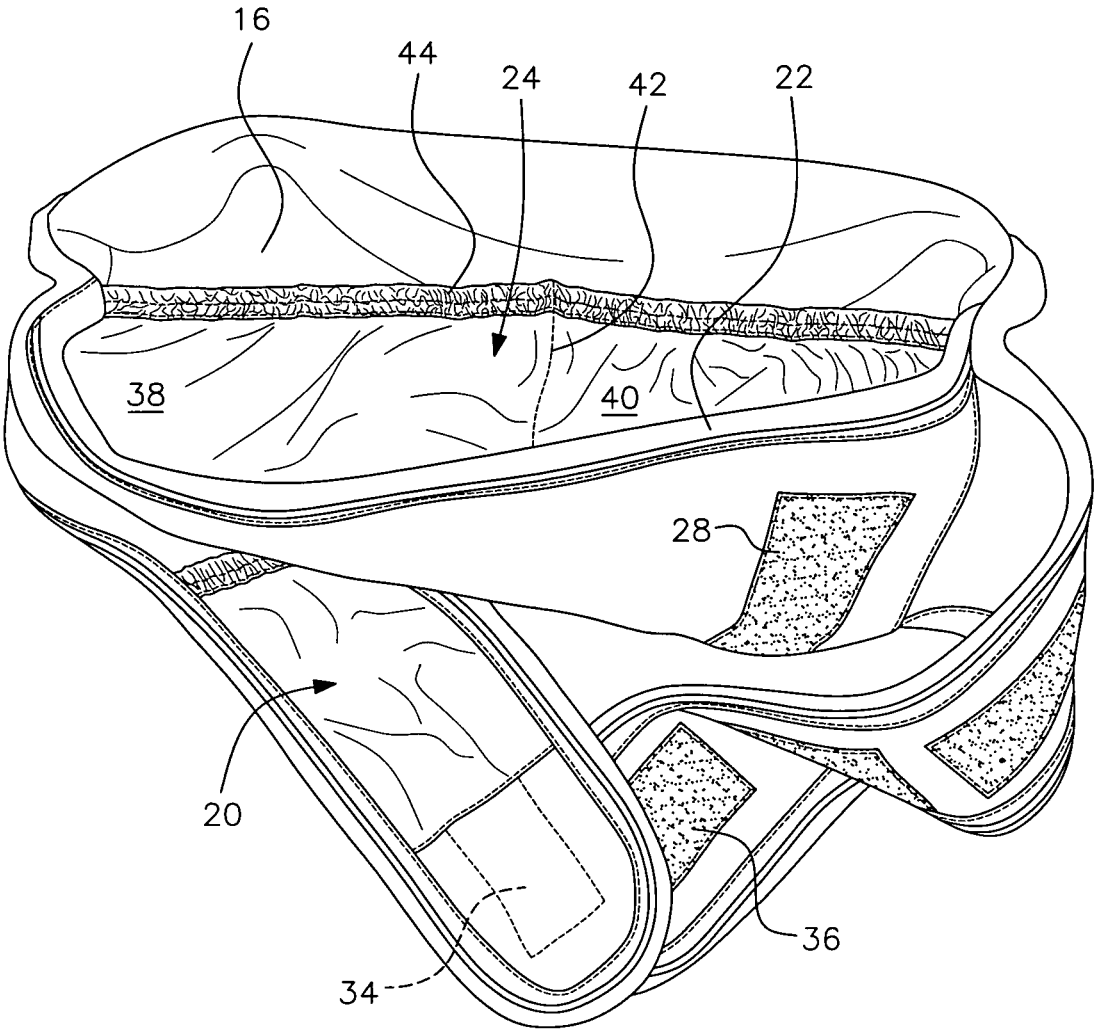
FIG. 3 illustrates the pocket for storing the contents of the backpack.

As shown in FIG. 3, the interior pocket 24 formed by a spacing away of layer of material 22 from upper pocket portion 16 exposes two interior pockets 38, 40 separated by stitch line 42. The tops of the pockets 38, 40 have an elastic band 44 which is stretchable to position loose items such as pens and pencils or paperback books, for example, between the exposed portions of pockets 38, 40 as shown in FIG. 3 and the upper pocket portion 16 of the pocket 24. The space between the pockets 38, 40 and the layer of material 22, forming a front wall of pocket 24, are used to hold larger sized items such as textbooks and notebooks.

Figure 4:
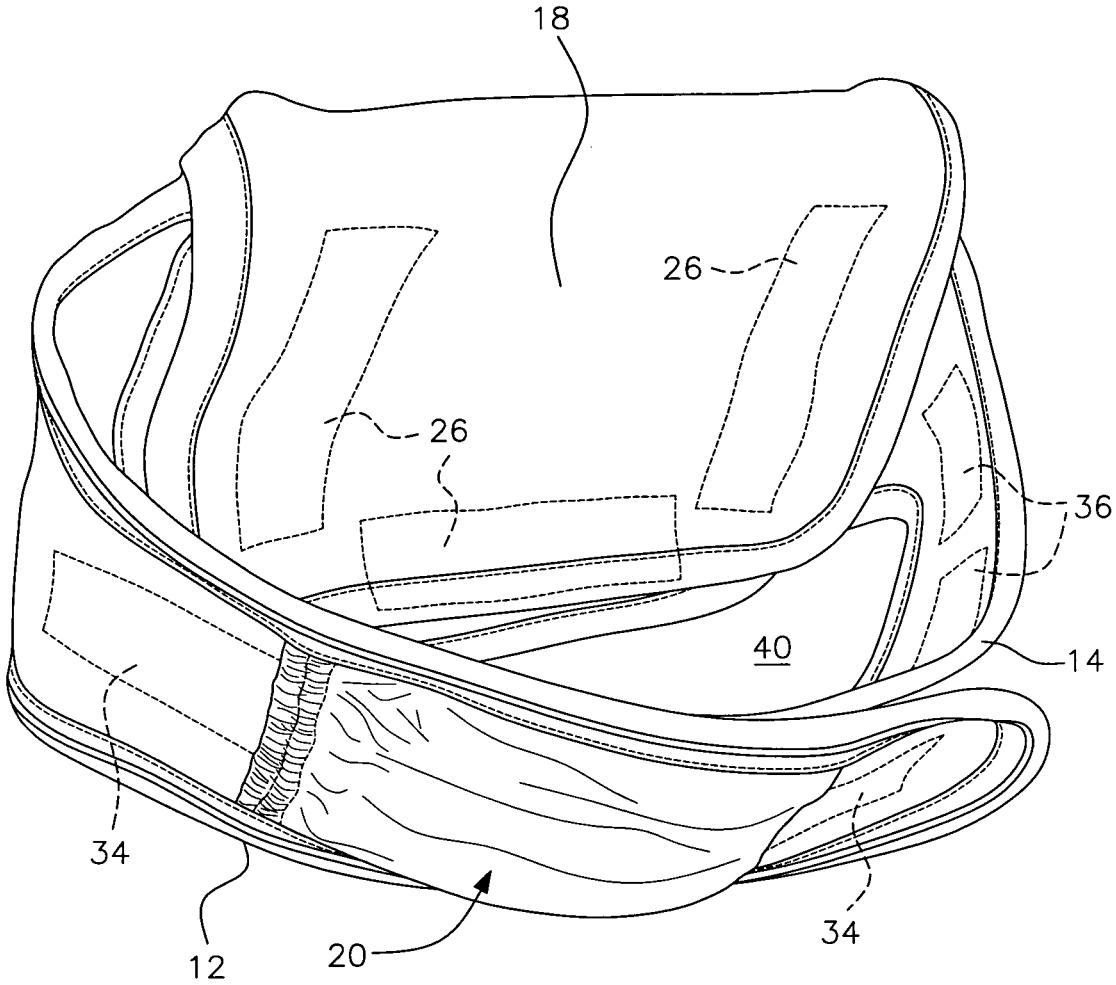
FIG. 4 illustrates the closing of a flap over the pocket of the backpack.

As shown in FIG. 4, the lower flap portion 18 is moved so that its parts 26 of the hook and loop fasteners overlie the complementary parts 28 of the layer of material 22, so as to engage with each other and securely fasten the lower flap portion 18 to the layer of material 22. The interengaged arms 12 and 14 are shown spaced from the lower flap portion 18, so as to provide an opening 40 which is normally occupied by an individual when the backpack is in use as shown in FIGS. 5 and 6.

Figure 5:
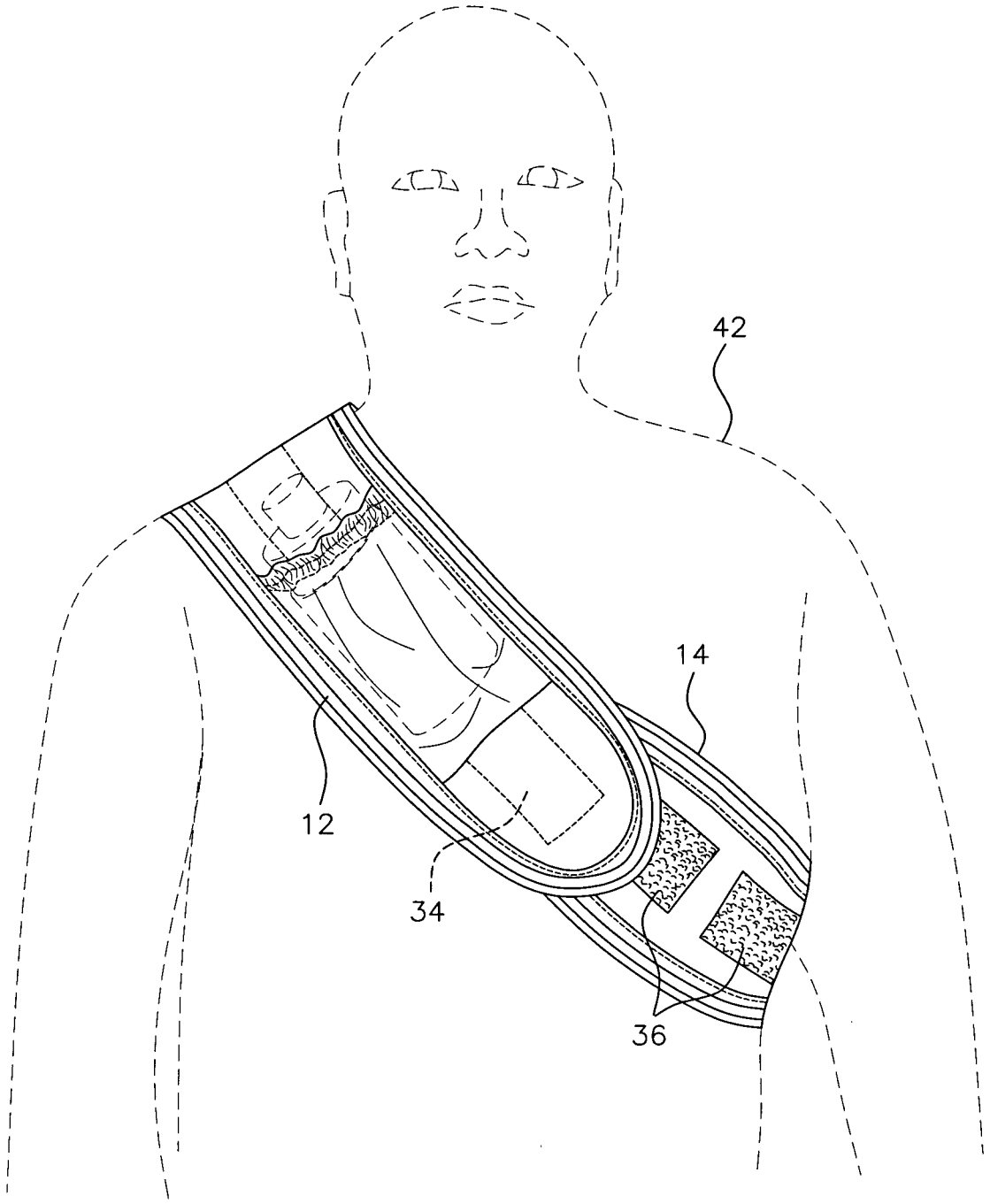
FIG. 5 is a front view of the interconnection of the two arms of the backpack across the chest of an individual.

In FIG. 5, the arm 12 overlies arm 14 across the chest of an individual 42 at an angle of approximately 45°. Parts 34 engage the parts 36 of the hook and loop fasteners after tightly stretching the arms 12 and 14 to lock the backpack onto an individual. The stretching of the arms causes a simultaneous stretching of the upper pocket portion 16 located on the back of an individual, so that the backpack is secured close to an individual with the lower flap portion 18 secured between the back of the individual and the layer of material 22.

Figure 6:
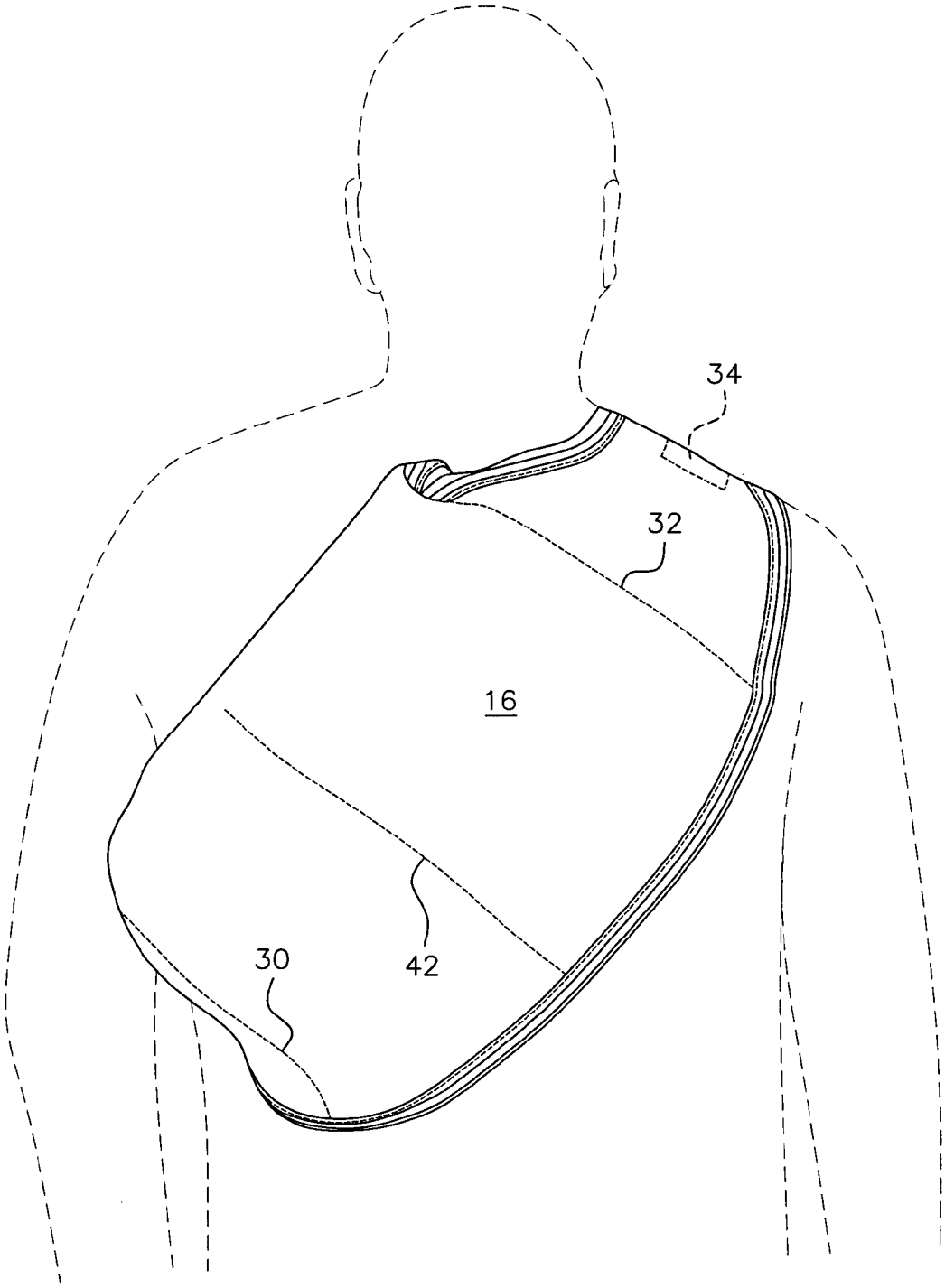
FIG. 6 is a rear view with the contents of the backpack worn on the back of the individual.

As shown in FIG. 6, the backpack is positioned over the shoulder of the individual, across the back at an angle of approximately 45° and under the arm of the opposite side of the individual. By the stretching of the arms 12, 14, the portion of the backpack positioned on the back of the individual tightly adheres to the back, so that the weight of the backpack is distributed across the back as well as across the chest of the individual. This greatly alleviates any pressure points on the individual which could potentially injure the wearer.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A backpack worn on the back of an individual and extending over the shoulder of one side of an individual and under the arm on the other side of the individual, said backpack consisting of at least one piece of T-shaped material having two arm portions, said at least one piece of T-shaped material having an interior surface and an exterior surface, said two arm portions extending laterally at an angle upwardly and away from opposite sides of an upper portion of a stem portion of the T-shaped material section so as to fit a curvature of the individual wearing the backpack at an angle around their body, a second piece of material secured on three sides to the interior surface so as to only cover the upper portion of the stem portion of the at least one piece of T-shaped material between the two arm portions to form a pocket between an interior surface of the second piece of material and the interior surface of the upper portion of the stem portion of the at least one piece of T-shaped material, a lower portion of the stem portion folding along a fold line to cover the second piece of material secured on three sides to the upper portion of the stem portion, when folded over the second piece of material, the exterior surface of the lower portion of the stem portion moves to cover an exterior surface of the second piece of material and be pressed against a back of the individual so that the layers proceeding outwardly from the back of the individual are, in order, the lower portion of the stem portion, the second piece of material and then the upper portion of the stem portion, said at least one piece of T-shaped material, said second piece of material and said two arm portions being stretchable material for forcefully compressing contents of the pocket and forcefully compressing the backpack against the individual, said two arm portions overlapping onto each other and being removably secured to each other in front of the individual and being positioned closest to the lower portion of the stem portion on the opposite side of the individual and being connected by at least one connector, said at least one connector being located between the two arm portions on opposed surfaces of the two arm portions, one of the two arm portions including a pocket having a longitudinal axis extending parallel to a longitudinal axis of the one arm portion so that an object held in the pocket is oriented vertically when the backpack is worn over the shoulder of one side of the individual, said pocket having an open edge, said open edge being an uppermost edge of said pocket to retain contents of the pocket while the contents of the pocket extend into the pocket and at least partially out of the pocket for ease of accessibility, said pocket being on an opposite side of the interior surface of the at least one piece of T-shaped material section and on an opposite side of the body from the at least one piece of T-shaped material when worn by the individual.

2. The backpack according to claim 1, wherein the two arm portions are removably interconnected by hook and loop fasteners.

3. The backpack according to claim 1, wherein the lower portion of the stem portion is removably secured to the second piece of material by hook and loop fasteners.

4. The backpack according to claim 1, wherein the at least one piece of T-shaped material is a single piece of material.

5. The backpack according to claim 4, wherein the second piece of material is a single piece of material.

6. The backpack according to claim 1, wherein said at least one of T-shaped material is neoprene.

7. The backpack according to claim 6, wherein the second piece of material is neoprene.

8. The backpack according to claim 7, wherein the neoprene is type-G neoprene.

* * * * *